US005127488A

United States Patent [19]

Shanahan

[11] Patent Number: 5,127,488

[45] Date of Patent: Jul. 7, 1992

[54] POWER ACCESSORY FOR SKATEBOARD

[75] Inventor: Thomas A. Shanahan, Atascadero, Calif.

[73] Assignee: Tom Shanahan, Inc., San Luis Obispo, Calif.

[21] Appl. No.: 721,994

[22] Filed: Jun. 27, 1991

[51] Int. Cl.[5] ..... A63C 5/08

[52] U.S. Cl. ..... 180/181; 180/11; 180/180; 280/43; 280/87.042

[58] Field of Search ..... 180/180, 181, 11, 22, 180/209; 280/87.042, 87.01, 43

[56] References Cited

U.S. PATENT DOCUMENTS

| | | | |
|---|---|---|---|
| 4,069,881 | 1/1978 | Shiber | 180/181 |
| 4,073,356 | 2/1978 | Schlicht | 180/181 |
| 4,094,372 | 6/1978 | Notter | 180/181 |

FOREIGN PATENT DOCUMENTS

| | | | |
|---|---|---|---|
| 874619 | 8/1942 | France | 180/11 |
| 2447210 | 9/1980 | France | 180/180 |

*Primary Examiner*—Eric D. Culbreth
*Attorney, Agent, or Firm*—Daniel C. McKown

[57] ABSTRACT

A power supplying accessory that can readily be retrofitted to an unpowered skateboard includes a leaf spring having a front end and a rear end; the front end including holes sized and spaced to fit on the threaded fasteners that attach the rear truck to the body of the skateboard; the leaf spring being secured between the rear truck and the body of the skateboard; the rear end of the leaf spring being attached to a drive assembly that includes an internal combustion engine, a drive wheel and a speed reducer; the leaf spring, in its unloaded condition, holding the drive wheel below an imaginary ground plane tangent to both the front and rear wheel of the skateboard, so that when the skateboard is loaded, the leaf spring preloads the drive wheel against the ground while the use of the rear truck of the skateboard permits the skateboard to retain its steering characteristics, thereby making it easy to learn to use.

1 Claim, 2 Drawing Sheets

POWER ACCESSORY FOR SKATEBOARD

BACKGROUND OF THE INVENTION

1. Field of the Invention

The present invention is in the field of sporting goods and more specifically relates to a power supplying accessory that can be retrofitted to existing skateboards.

2. THE PRIOR ART

In U.S. Pat. No. 4,069,881, Shiber describes an auxiliary power unit for a skateboard. The wheels of the auxiliary power unit serve as a replacement for the rear truck of the skateboard, and in order to use his device, the skateboard must be provided with an attachment that extends about the top surface of the skateboard. Thus, Shiber's unit could not be attached to an existing skateboard without considerable modification of the skateboard.

In U.S. Pat. No. 4,073,356, Schlicht shows a skateboard in which an auxiliary power unit is mounted in the center of the skateboard. The diameter of the driving wheel is such that the wheel does not touch the pavement unless the board is loaded. It would appear that this power unit cannot be mounted to a skateboard without permanently altering the skateboard.

In U.S. Pat. No. 4,094,372, Notter shows an auxiliary power unit that is mounted to the rear truck of the skateboard and which supplies power to the rear wheels of the skateboard. In contrast, in the present invention, the auxiliary power unit adds a drive wheel to the skateboard.

None of these patents shows the present invention which has unique advantages.

SUMMARY OF THE INVENTION

The present invention is an auxilliary power unit that can be attached to a skateboard. The auxilliary power unit is attached to the skateboard by the same bolts that are used to attach the rear truck of the skateboard. An elongated leaf spring connects the auxilliary power unit to the skateboard.

Thus, the accessory of the present invention can be retrofitted to existing skateboards. One simply removes the rear truck of the skateboard, passes the bolts through the holes in the leaf spring, and then re-attaches the rear truck.

The shape and strength of the leaf spring are such that when the skateboard is unloaded, the rear wheel of the skateboard is lifted from the ground. When the skateboard is loaded, the driving wheel is urged against the ground by the leaf spring.

The structure and operation of the accessory of the present invention will be better understood in connection with the detailed description given below and in connection with the accompanying drawings, which are for the purpose of illustrating a preferred embodiment of the invention but which are not intended to limit the invention.

DETAILED DESCRIPTION OF THE PREFERRED EMBODIMENT

Figure 1:
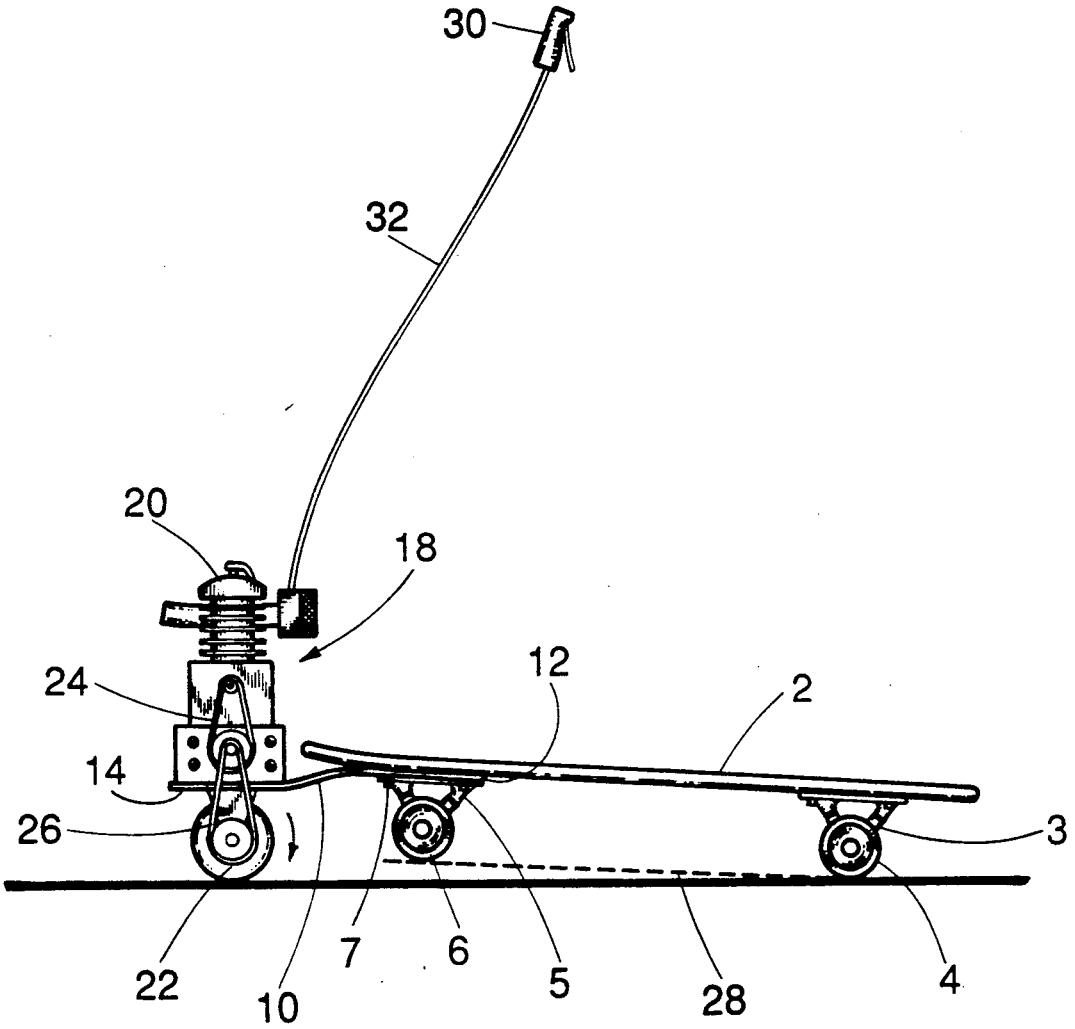
FIG. 1 is a side elevational view of a skateboard with the accessory of the present invention installed.

The power accessory of the present invention is intended for use with a skateboard of the conventional type which has a body 2, a front truck 3 attached to the body and including a front wheel 4. The skateboard further includes a rear truck 5 attached to the body 2 by threaded fasteners of which the fastener 7 is typical. The rear wheel 6 is mounted on the rear truck 5.

Figure 2:
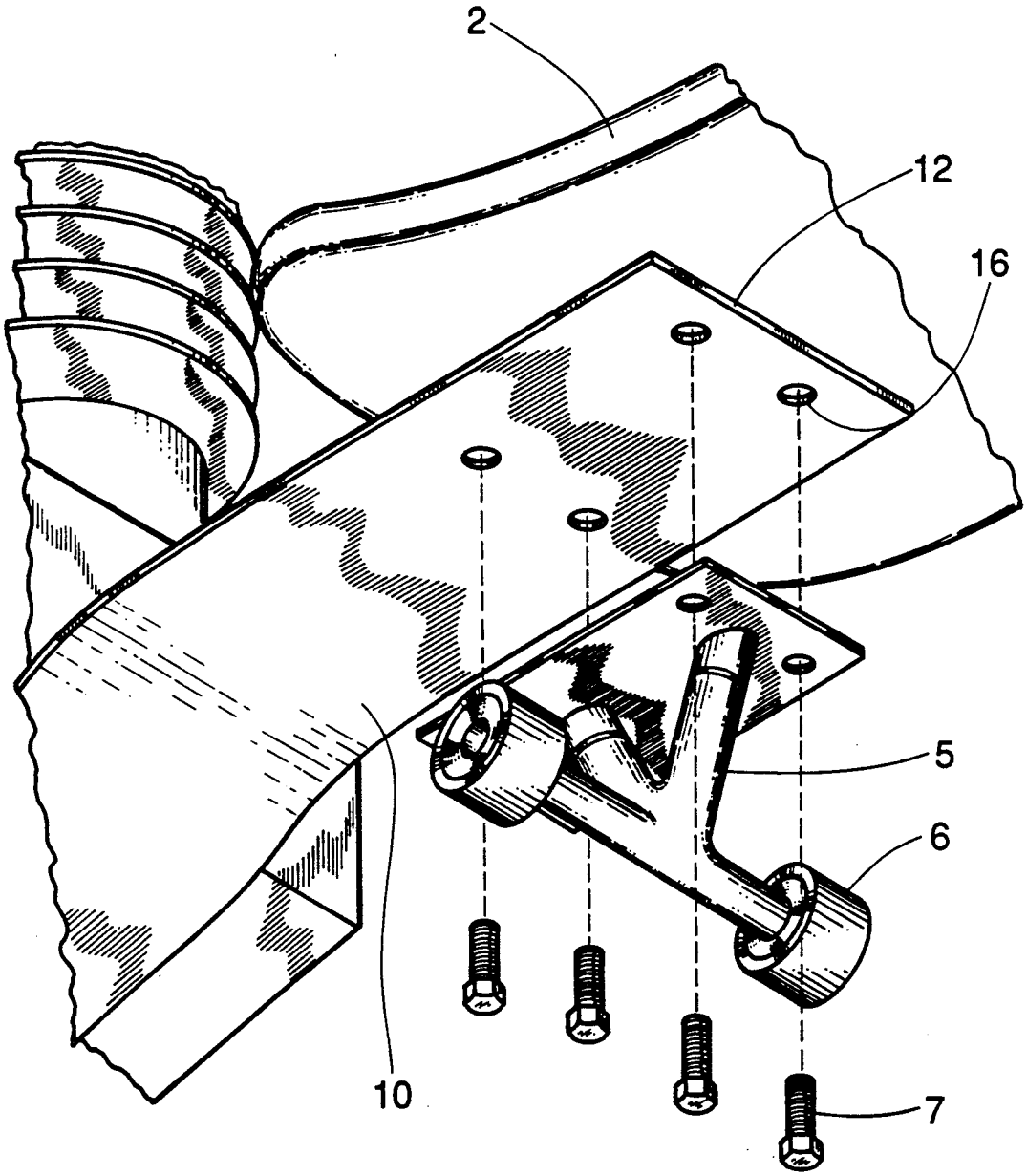
FIG. 2 is a fractional perspective view showing how the accessory of the present invention is attached to a skateboard.

The power accessory is connected to the skateboard by means of the leaf spring 10. As best seen in FIG. 2, the connection is made by unbolting the rear truck 5, inserting the leaf spring 10 between the rear truck and the body 2 of the skateboard, and thereafter bolting the rear truck 5 to the body 2 by means of the threaded fasteners 7. Since practically all skateboards have rear trucks that are removably attached to the body by threaded fasteners, either bolts or studs, the power accessory of the present invention is capable of being installed on practically any skateboard that has been built in recent years.

The structure which makes this possible is the holes, of which the hole 16 is typical, in the front end 12 of the leaf spring 20.

The rear end of the leaf spring serves as a base to which the drive assembly 18 is mounted. The drive assembly includes an internal combustion engine 20 and a drive wheel 22. The shaft of the internal combustion engine is connected to the drive wheel 22 by means of a speed reduction belt 24 and a speed reducing chain 26.

As best seen in FIG. 1, in the preferred embodiment, the leaf spring 10 has a slight offset in it so that when the leaf spring is connected to the body 2 of the skateboard, the rear wheel 6 of the skateboard is off the ground when the skateboard is unloaded. That is, the drive wheel 22 extends below an imaginary ground plane 28 tangent to the front wheel 4 and the rear wheel 6. When the skateboard is loaded, the leaf spring 10 is deflected from its unloaded position, and the elastic restoring forces in the leaf spring urge the drive wheel 22 into preloaded contact with the ground. When the skateboard is loaded, the rear wheel 6 is in contact with the ground so that the stiffness of the rear truck can stabilize the rear portion of the skateboard. Since most of the user's weight will be borne by the front wheel 4 and the rear wheel 6, the preloading of the drive wheel 22 against the ground is essential. On the other hand, the use of the front and rear trucks of the skateboard results in the skateboard having the same steering characteristics after installation of the power unit as it did before, thereby making it easy for the user to adapt to power operation.

The speed of the internal combustion engine 20 is controlled by a hand grip 30 that is mounted at the end of a cable 32 and that is held in the user's hand.

Thus, there has been described a power-supplying accessory that can be retrofitted to existing skateboards without having to make any permanent alterations to the skateboard. The skateboard retains its steering characteristics after the power accessory has been installed.

Workers in the art will recognize that a number of variations on the preferred embodiment described above can be made without departing from the spirit of the present invention. Such variations are deemed to be within the scope of the present invention.

What is claimed is:

1. A power supplying accessory that can readily be attached to an unpowered skateboard having a body, having a front truck including a front wheel, and having a rear truck including a rear wheel, said rear truck being removably attached to the body of the skateboard by threaded fasteners, said power supplying accessory comprising:

a leaf spring having a front end and a rear end;

said front end including holes sized and spaced to fit on the threaded fasteners, whereby said leaf spring can be inserted between the rear truck and the body of the skateboard;

a drive assembly attached to the rear end of said leaf spring and including an internal combustion engine, a drive wheel, and speed reduction means interconnecting said internal combustion engine and said drive wheel;

said leaf spring, when unloaded, holding said drive wheel below an imaginary ground plane tangent to both said front wheel and said rear wheel, so that when said skateboard is loaded, said leaf spring preloads said drive wheel against the ground.

* * * * *